United States Patent [19]

Bandou et al.

[11] Patent Number: 4,706,487

[45] Date of Patent: Nov. 17, 1987

[54] METHOD OF MANUFACTURING A VALVE SLEEVE

[75] Inventors: Masaaki Bandou, Sakado; Masao Sugita, Higashimatsuyama; Takachi Marumo, Maebashi, all of Japan

[73] Assignee: Jidosha Kiki Co., Ltd., Tokyo, Japan

[21] Appl. No.: 870,200

[22] Filed: Jun. 2, 1986

[30] Foreign Application Priority Data

Jun. 3, 1985 [JP] Japan ..... 60-119975

[51] Int. Cl.[4] ..... B21K 1/20

[52] U.S. Cl. ..... 72/355; 72/358

[58] Field of Search ..... 72/344, 345, 348, 355, 72/358, 370

[56] References Cited

U.S. PATENT DOCUMENTS

| | | | |
|---|---|---|---|
| 1,651,231 | 11/1927 | Shrum | 72/355 |
| 1,714,398 | 5/1929 | O'Bannon . | |
| 1,870,970 | 8/1932 | Stevenson . | |
| 2,027,922 | 1/1936 | McNaught . | |
| 2,079,513 | 5/1937 | Lapsley . | |
| 2,689,359 | 9/1954 | Friedman . | |
| 2,947,081 | 8/1960 | Clevenger | 72/370 |
| 3,591,139 | 7/1971 | Bishop . | |
| 4,070,897 | 1/1978 | Linz | 72/345 |
| 4,103,407 | 8/1978 | Elizalde et al. . | |
| 4,166,373 | 9/1979 | Braun . | |
| 4,291,568 | 9/1981 | Stifano, Jr. . | |
| 4,292,831 | 10/1981 | Simon . | |
| 4,317,356 | 3/1982 | Stell | 72/355 |
| 4,419,877 | 12/1983 | Alfano . | |
| 4,442,579 | 4/1984 | Millard . | |
| 4,535,519 | 8/1985 | Kajikawa et al. . | |
| 4,543,813 | 10/1985 | Rogers | 72/370 |

FOREIGN PATENT DOCUMENTS

| | | | |
|---|---|---|---|
| 132935 | 10/1979 | Japan . | |
| 91945 | 7/1981 | Japan | 72/344 |
| 130643 | 7/1984 | Japan . | |
| 189028 | 10/1984 | Japan . | |

*Primary Examiner*—Lowell A. Larson

*Attorney, Agent, or Firm*—Flynn, Thiel, Boutell & Tanis

[57] ABSTRACT

A method of manufacturing a valve sleeve is disclosed which is adapted to construct an oil rotary valve together with a valve rotor, and a valve sleeve of a configuration which is suitably formed by carrying out the method is also disclosed. The valve sleeve has an axially extending groove in its inner surface, and the bottom surface of the groove has a portion which is disposed at an angle with respect to the axis. The method of manufacturing comprises shaping a cylindrical member having an inner and an outer diameter, both of which are greater than those of a valve sleeve to be manufactured, inserting a punch into the material, and applying a compression to the material from the radially outside thereof to cause the internal surface of the material to bear against the punch.

8 Claims, 26 Drawing Figures

METHOD OF MANUFACTURING A VALVE SLEEVE

BACKGROUND OF THE INVENTION

The invention relates to a valve sleeve which forms an oil rotary valve and a method of manufacturing same.

An oil rotary valve as used in a power steering apparatus, for example, comprises a valve rotor in which a plurality of axial grooves are formed, and a valve sleeve which is rotatably fitted around the valve rotor and formed with axial grooves in its inner surface which can be aligned with the circumferentially opposite sides of a groove in the valve rotor. In response to a relative rotational displacement between the valve rotor and the valve sleeve, the supply and discharge of hydraulic fluid to or from a power cylinder can be controlled. The grooves formed in the valve sleeve are defined as blind grooves, namely, a groove in which only its middle portion is recessed to serve as a groove while the opposite ends must not be recessed.

A technique which forms such blind groove in the inner surface of a cylindrical valve sleeve is disclosed in Japanese Patent Publication No. 49,541/1974. In this technique, a cutter of a given size is repeatedly driven back and forth along an arcuate path of movement into the inside of a cylindrical material to form a single groove. A plurality of grooves are formed successively by synchronously rotating the cylindrical material. However, the described technique suffers from disadvantages that an apparatus having a complex construction is required and an increased length of working time is necessary.

SUMMARY OF THE INVENTION

Therefore, it is an object of the invention to provide a method of manufacturing a valve sleeve having a blind groove in its inner surface, by a press operation which operates through a simple rectilinear motion. This object is achieved by inserting a punch into a cylindrical material having an inner and an outer diameter which are greater than those of a valve sleeve to be manufactured, and subsequently compressing the material radially from the outside to cause the inner surface of the material to abut against the punch.

It is another object of the invention to provide a valve sleeve having a configuration which is preferred for its manufacturing by a press operation having a rectilinear motion.

DESCRIPTION OF EMBODIMENTS

Figure 1:
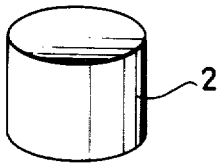
FIG. 1 is a perspective view of a solid cylindrical material.
Figure 2:
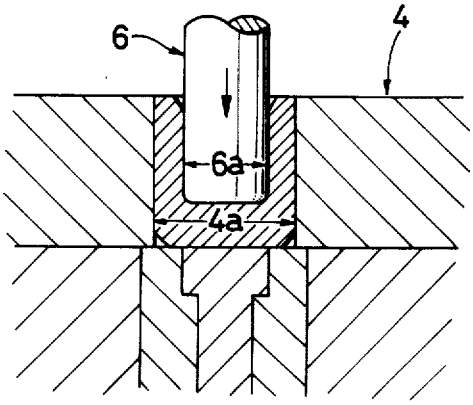
FIG. 2 is a longitudinal section illustrating a step of shaping a hollow cylindrical material.
Figure 3:
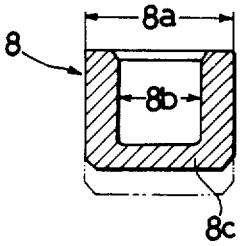
FIG. 3 is a longitudinal section of the cylindrical member.

Referring to the drawings, several embodiments of the invention will now be described. Initially, a solid cylindrical material 2 as shown in FIG. 1 is formed by a machining, a cold or hot forging operation, and the material 2 is then placed in a press die 4 as shown in FIG. 2. A solid cylindrical punch 6 having a given outer diameter is then used to perform a press operation, whereby a hollow cylindrical material 8 having a bottom as shown in FIG. 3 is shaped. The inner diameter 4*a* of the press die 4 and the outer diameter 6*a* of the cylindrical punch 6 are greater than the outer diameter and the inner diameter, respectively, of a valve sleeve to be manufactured. Accordingly, the cylindrical material 8 which is shaped has an outer diameter 8*a* and an inner diameter 8*b* which are greater than the outer and the inner diameter of a valve sleeve to be manufactured. Where the bottom 8*c* of the cylindrical material 8 which is shaped by the press operation has a thickness greater than a desired value, the thickness is reduced to a given value by removing the material as by a cutting operation. A through hole 8*d* is then formed centrally in the bottom 8*c* of the cylindrical material 8, resulting in a configuration as shown in FIG. 4.

Figure 4:
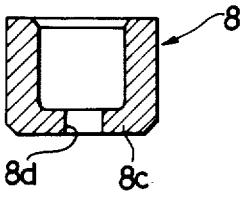
FIG. 4 is a longitudinal section of the cylindrical member having a hole formed in its bottom.
Figure 5:
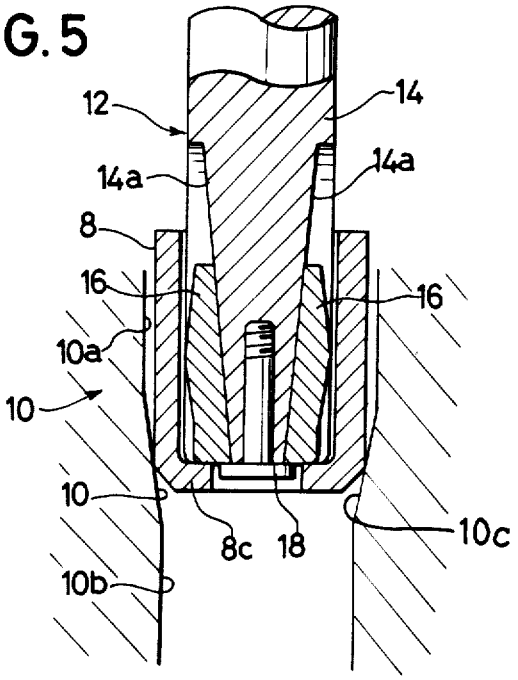
FIG. 5 is a longitudinal section illustrating a first stage of a step of forming a blind groove.
Figure 6:
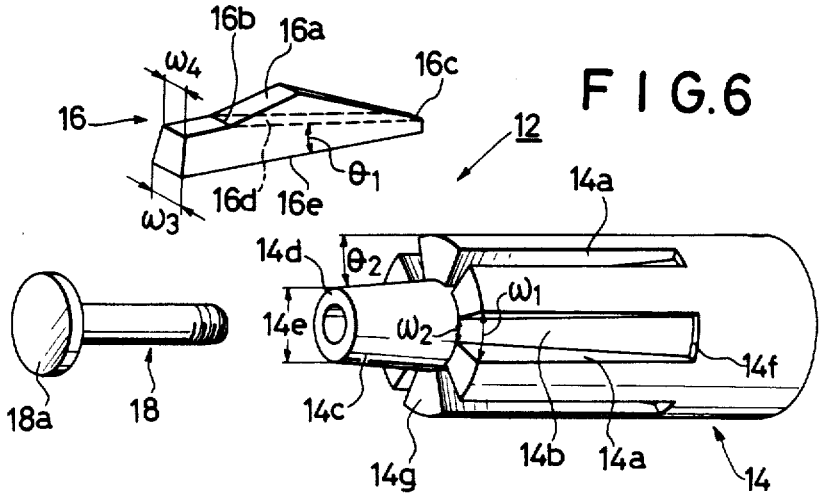
FIG. 6 is an exploded perspective view of a punch.

In the next step, a plurality of axially extending blind grooves are formed in the inner surface of the cylindrical material 8 shown in FIG. 4. A press die 10 used in this step comprises a section 10*a* having an inner diameter greater than the outer diameter 8*a* of the cylindrical material 8, another section 10*b* having an inner diameter which is substantially identical with the outer diameter of a valve sleeve to be manufactured, and a tapered surface 10*c* which joins the both sections 10*a* and 10*b*, as indicated in FIG. 5. Accordingly, when the cylindrical material 8 is disposed inside the press dia 10, the material 8 comes to a stop upon abutment of the peripheral edge of the bottom thereof against the tapered surface 10*c*. A punch 12 which is shown in an exploded view in FIG. 6 is used to apply a press operation upon the material 8 which is thus disposed.

The punch 12 comprises a punch pin 14, six punch members 16 which are carried in the outer periphery of the punch pin 14, and a screw 18 which prevents the punch members 16 from being disengaged from the punch pin 14. The punch pin 14 has an outer diameter which is substantially identical to the inner diameter of a valve sleeve to be manufactured, and is formed with six axially extending notches 14*a* at an equal interval in its outer peripheral surface. These notches 14*a* are formed so that they exhibit a depth which gradually increases toward the front end of the punch pin 14, or to the left as viewed in FIG. 6. In other words, the bottom surface 14*b* of each of the six notches 14*a* is tapered toward the front end. In addition, the punch pin includes a projecting tapered portion 14*c* which continues from the bottom surfaces 14*b* of the notches and disposed at the front end of the punch pin. The notches 14*a* are shaped such that a width $w_1$ as measured around the outer surface is less than a width $w_2$ as measured along the bottom surface 14*b*. The punch member 16 includes a machining surface 16*a* which is chevron-shaped in longitudinal section, and a bottom surface 16*e* which is inclined at an angle of $\theta_1$ with respect to a plane 16*d* which joins the both base lines 16*b* and 16*c* of the machining surface 16*a*. The angle $\theta_1$ substantially matches an angle of inclination $\theta_2$ of the tapered portion 14*c* of the punch pin 14. The bottom surface 16*e* has a width $w_3$ greater than a width $w_4$ of the machining surface 16*a*, and the both widths $w_3$ and $w_4$ are less than the width $w_2$ of the bottom surface and the width $w_1$ along the outer periphery of the notch 14*a*, respectively. Accordingly, by fitting each punch member 16 into an individual one of the notches 14*a* formed in the punch pin 14, and sliding the punch member relative to the notch 14*a*, it is possible to move the punch member 16 outward or inward in the radial direction of the punch pin 14. The width $w_3$ of the bottom surface 16*e* of the punch member 16 is greater than the width $w_1$ around the outer periphery of the notch 14*a*, whereby the disengagement of the punch member 16 radially outward from the punch pin 14 is prevented. The screw 18 has a head 18*a* of an outer diameter which is greater than the outer diameter 14*e* of a foremost end 14*d* of the projecting tapered portion 14*c* of the punch pin 14. Thus, after fitting the punch members 16 into the notches 14*a* in the punch pin 14 and clamping the screw 18, axial disengagement of the punch members 16 from the punch pin 14 is prevented while allowing the punch members to move together with the punch pin 14.

Figure 7:
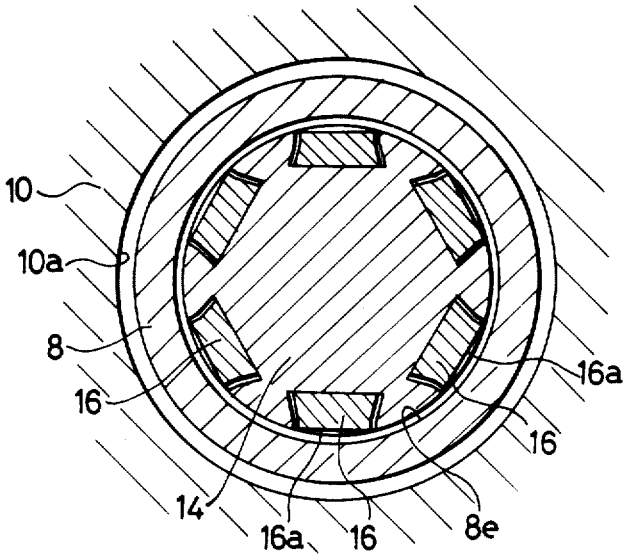
FIG. 7 is a cross section of the stage shown in FIG. 5.

The process of plastically deforming the hollow cylindrical member 8 by a press operating using the press die 10 and the punch 12 will now be described. In FIG. 5, the material 8 is disposed within the press die 10, and the punch 12 is inserted into the material 8. The punch members 16 have travelled toward the front end of the punch pin 14 and thus remain at rest in abutment against the head 18*a* of the screw 18. Under this condition, the punch members 16 assume positions indicated in FIG. 7 where they have been retracted to the greatest extent toward the axis of the punch pin 14 and the machining surface 16*a* of the punch member 16 is clear from the inner surface 8*e* of the material 8.

Figure 8:
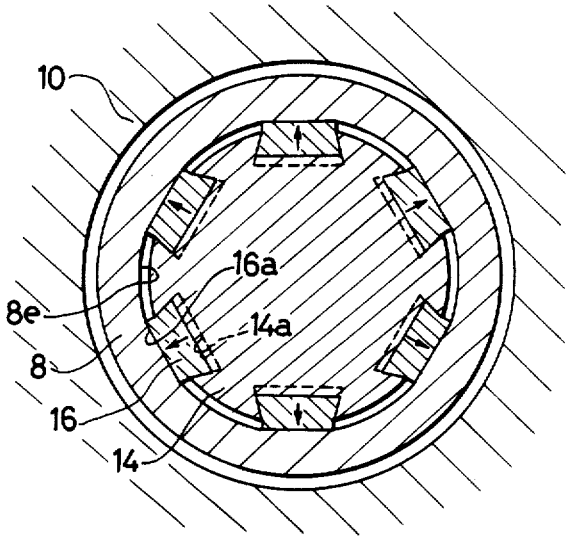
FIG. 8 is a cross section of a second stage.

Subsequently when the punch pin 14 is lowered, the individual punch members 16 cannot move down as a result of their abutment against the bottom 8*c* of the material 8, and hence they are raised relative to the punch pin 14. The tapered configuration of the notches 14*a* formed in the punch pin 14 causes the punch members 16 to be driven radially outward as they are raised relative to the punch pin 14, thus bringing the machining surface 16*a* of the punch member 16 into abutment against the inner surface 8*e* of the material 8 as shown in FIG. 8.

Figure 9:
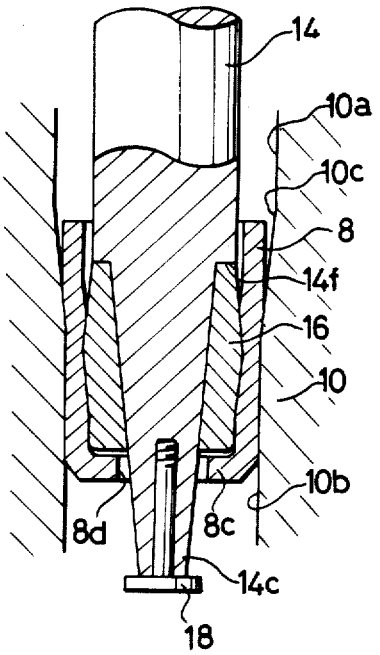
FIG. 9 is a longitudinal section of a third stage.
Figure 10:
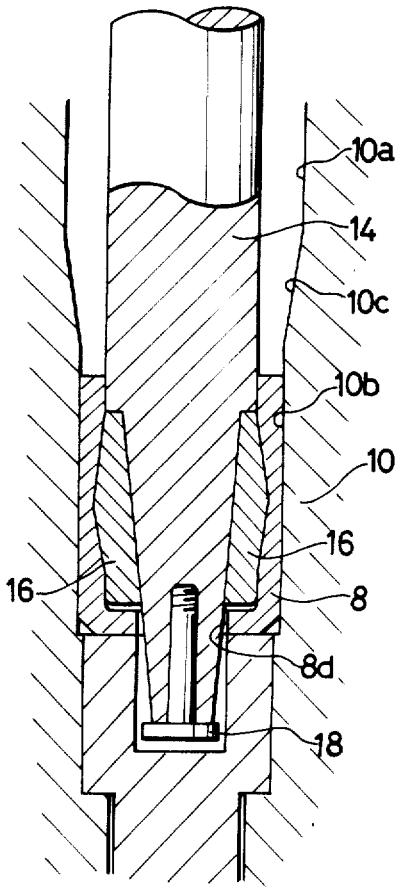
FIG. 10 is a longitudinal section of a fourth stage.
Figure 11:
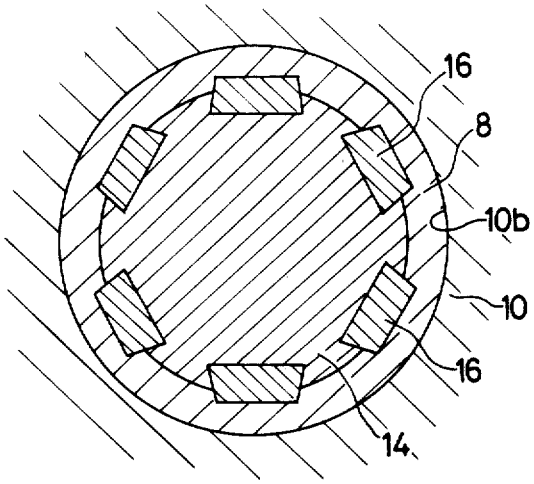
FIG. 11 is a cross section of the stage shown in FIG. 10.

As the punch pin 14 is lowered further downward, the abutment of the punch members 16 against the upper end face 14*f* of the notches 14*a* prevent their movement relative to the punch pin, whereby the force applied to move the punch pin 14 down is effectively transmitted to the bottom 8*c* of the material, as a result of the abutment of the step 14*g* thereof against the bottom thus causing a downward movement of the material 8. As a consequence, the material 8 is gradually pressed into the area defined by the tapered surface 10*c* and thence into the reduced diameter portion 10*b* of the press die 10, as shown in FIG. 9, and is eventually pressed into the reduced diameter portion 10*b* completely, as shown in FIG. 10. The reduced diameter portion 10*b* has an inner diameter which is substantially equal to the outer diameter of a valve sleeve to be manufactured and which is less than the outer diameter of the material 8, so that the material 8 is compressed radially inward as it is driven downward, whereupon the machining surface 16*a* of the punch member 16 is forced into the internal surface of the material 8, thus forming an axial groove (see FIG. 11). It is to be noted that when the punch member 16 assumes its uppermost position relative to the punch pin 14, the projecting tapered portion 14*c* of the punch pin 14 and the screw 18 project downward through the opening 8*d* formed in the bottom 8*c* of the cylindrical member 8.

Figure 12:
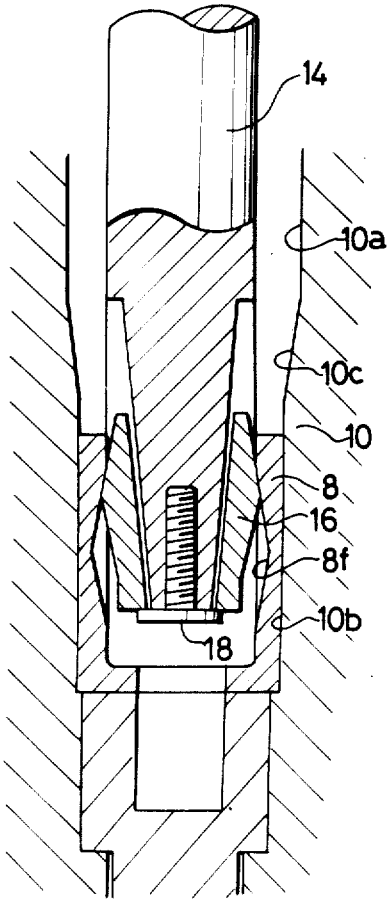
FIG. 12 is a longitudinal section of a fifth stage.

After the axial groove is formed in the internal surface of the material 8 in the manner mentioned above, the punch pin 14 is raised. Because the individual punch member 16 bite into the grooves 8*f* formed in the material 8, they cannot move upward, and thus move relative to the punch pin 14 toward the front end thereof. This allows the punch members 16 to retract radially inward, and as the punch pin 14 is raised further upward, the punch members engage the screw 18 to be disengaged from the grooves 8*f*, whereby they are capable of being carried upward by the punch pin 14 (see FIG. 12).

Figure 13:
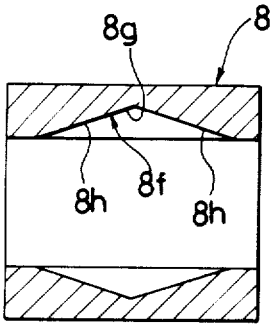
FIG. 13 is a longitudinal section of a valve sleeve.

Subsequently, the cylindrical member 8 having axial blind grooves 8*f* formed therein may be removed from the press die 10 as by a knock-out pin, and then subject to a finishing operation for the internal and the external surface thereof to complete a valve sleeve. As shown in FIG. 13, the valve sleeve manufactured as a result of the described steps has an axial blind groove 8*f* defined by a pair of bevelled surfaces 8*h* which exhibits the greatest depth at the axial center 8*g* thereof. Forming the groove 8*f* which has its bottom surface defined by the bevelled surfaces 8*h* provides an advantage that the withdrawal of the punch 12 is facilitated in that the punch 12 slides along the bevelled surfaces 8*h*. It will be appreciated that the formation of a blind groove in the internal surface of a valve sleeve which has been considered difficult to achieve can be accomplished in accordance with the invention by repeating a simple rectilinear motion.

Figure 26:
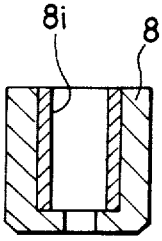
FIG. 26 is a longitudinal section of another form of cylindrical material.

In the described embodiment, the notch 14*a* formed in the punch pin 14 has a width which is greater toward its bottom ($w_2$) than at its outer surface ($w_1$) to prevent the withdrawal of the punch members 16, but it should be understood that a blind groove can also be formed by using a notch which has a uniform width. While a valve sleeve having six blind grooves has been illustrated above, it will be appreciated that the number of blind grooves is not limited thereto. A variety of material such as structural carbon steel or alloyed steel may be used for the cylindrical material 8. In addition, a hollow cylindrical, metallic material 8 having fitted therein a cylinder 8*i* of a different material such as formed of resin, as indicated in FIG. 26, may also be used. A choce of any desired material is enabled in this instance, in consideration of the machineability.

Figure 14:
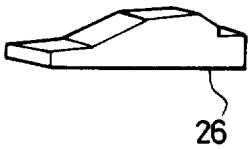
FIG. 14 is a perspective view of another form of punch member.
Figure 15:
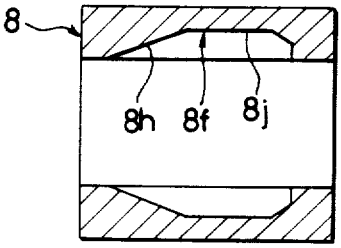
FIG. 15 is a longitudinal section of a valve sleeve manufactured with the punch member shown in FIG. 14.
Figure 16:
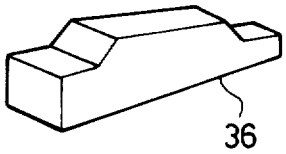
FIG. 16 is a perspective view of a further form of punch member.
Figure 17:
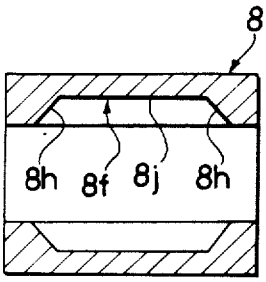
FIG. 17 is a longitudinal section of a valve sleeve manufactured with the punch member shown in FIG. 16.
Figure 18:
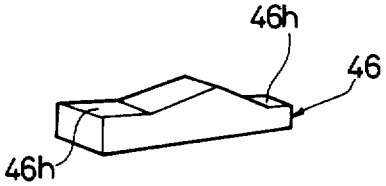
FIG. 18 is a perspective view of still another form of punch member.

In addition, the configuration of the groove to be formed in the valve sleeve is not limited to one shown in FIG. 13. By way of example, a punch member 26 as illustrated in FIG. 14 may be used to form a groove 8*f* having a bottom surface which includes a constant depth portion 8*j* which is contiguous to bevelled portions 8*h*, as shown in FIG. 15. Furthermore, a punch member 36 as illustrated in FIG. 16 may be used to form a pair of bevelled surfaces 8*h* at the opposite ends of the groove 8*f* and which are joined by a portion 8*j* of a constant depth, located therebetween, as shown in FIG. 17. The grooves shown in FIGS. 15 and 17 may be advantageous in that a greater volume is available within the groove. Finally, a punch member 46 having a pair of steps 46*h* at its opposite ends, as illustrated in FIG. 18, may be used to define a groove as shown in FIG. 13. Punch members 36, 46 as shown in FIGS. 16 and 18 which exhibit symmetrical machining surfaces with respect to the longitudinal center can be more easily manufactured.

Figure 19:
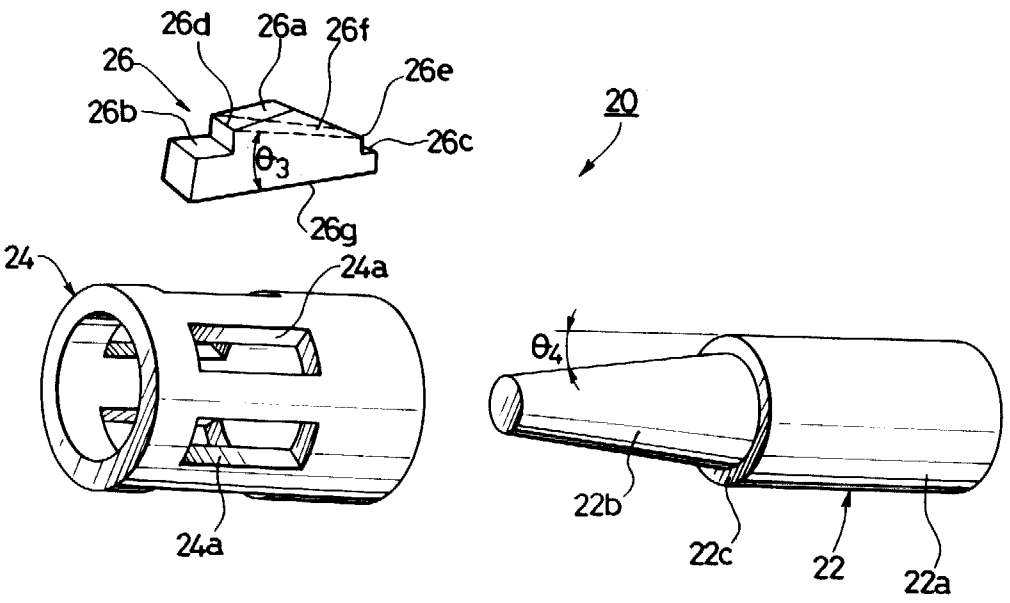
FIG. 19 is an exploded perspective view of a punch used in a second embodiment.
Figure 20:
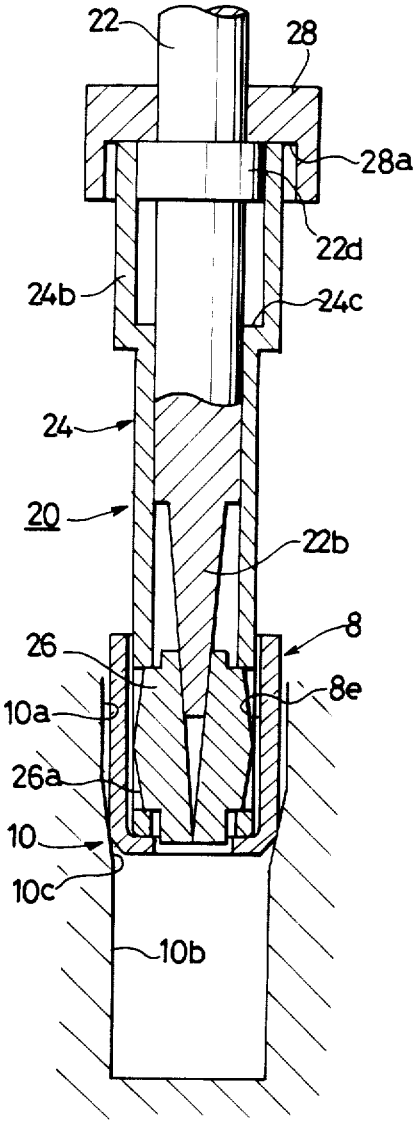
FIGS. 20 to 25 are a series of longitudinal sections illustrating sequential steps of manufacturing according to the second embodiment.

A second embodiment of the invention will now be described which employs a punch shown in FIG. 19 to effect a press operation. A punch 20 shown comprises a punch pin 22, a punch sleeve 24 which is fitted around the punch pin 22, and six punch members 26. The punch pin 22 comprises a solid cylindrical main portion 22*a*, a tapered portion 22*b* which is located at the front end thereof, and a step 22*c* defined between the main portion 22*a* and the tapered portion 22*b*. The punch sleeve 24 has an inner diameter which is substantially equal to the outer diameter of the main portion 22*a* of the punch pin 22 and an outer diameter which is substantially equal to the inner of a valve sleeve to be manufactured, with axially extending, rectangular openings 24*a* formed toward its front end and equally spaced apart circumferentially. The punch member 26 includes a machining surface 26*a* which is chevron-shaped in cross section, and a pair of steps 26*b*, 26*c* which are located on the opposite ends of the machining surface 26*a*, as viewed lengthwise thereof. In addition, the punch member includes a bottom surface 26*g* which is inclined by an angle $\theta_3$ with respect to a plane 26*f* which join the both base lines 26*d* and 26*e* of the chevron-shaped machining surface 26*a*. The angle $\theta_3$ substantially matches the angle of inclination $\theta_4$ of the tapered portion 22*b* as referenced to the main portion 22*a* of the punch pin 22. The punch 20 is assembled by fitting the individual machining surfaces 26*a* into the individual openings 24*a* with the end of the punch member 26 having an increased thickness oriented toward the front end of the punch sleeve 24 or to the left, as viewed in the drawing, and partly inserting the front end of the tapered portion 22*b* of the punch pin 22 into a space defined by the punch members 26. It is to be noted that the top of the punch sleeve 24 is formed with a portion 24*b* of an increased diameter as shown in FIG. 20 while the top of the punch pin 22 is formed with an annular projection 22*d* so as to be fitted into the portion 24*b* of the punch sleeve 24. A flange member 28 is secured around the punch sleeve 24, thus allowing the punch pin 22 to be displaced relative to the punch sleeve 24 through a distance defined between a step 24*c* on the punch sleeve 24 and the lower surface 28*a* of the flange member 28.

Figure 21:
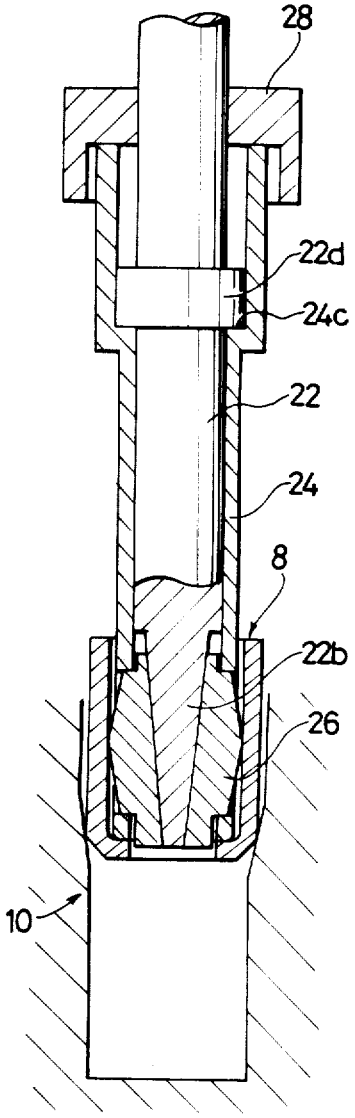
Figure 22:
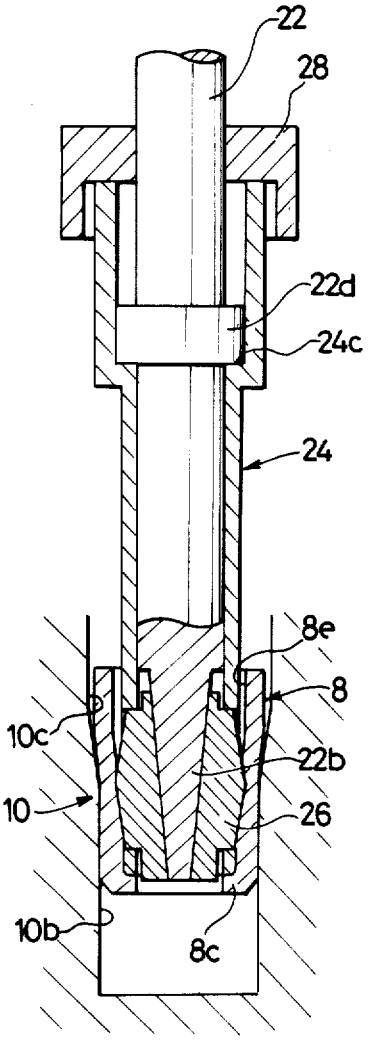
Figure 23:
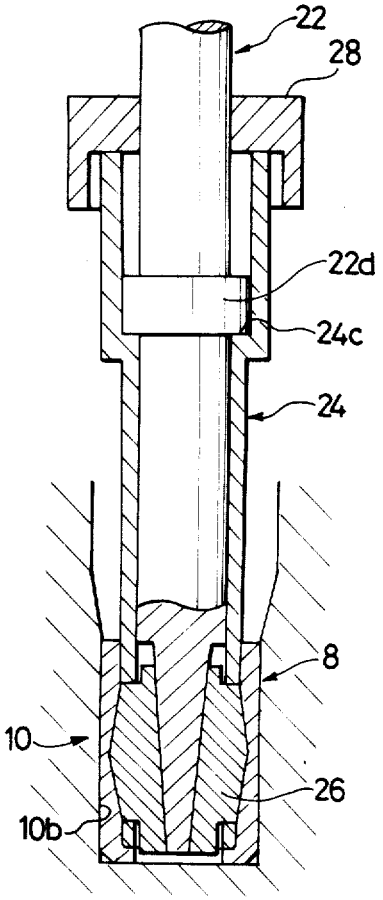

A press operation which uses the punch 20 described above will now be described. Initially, the hollow cylindrical material 8 is disposed within the press die 10, and the punch 20 is inserted into the material 8 (see FIG. 20). As in the previous embodiment, the material 8 remains at rest in abutment against the tapered surface 10*c* of the press die 10 while the punch pin 22 assumes its uppermost position relative to the punch sleeve 24, with only its front end of the tapered section 22*b* inserted into a space defined by the punch members 26. Accordingly, the individual punch members 26 assume a most retracted position which is nearer the axis of the punch 20, and hence the machining surface 26*a* of the punch member 26 is clear from the internal surface 8*e* of the cylindrical material 8. The punch pin 22 is then driven downward. The downward movement of the punch pin 22 is not transmitted to the punch sleeve 24 until the annular projection 22*e* on the punch pin 22 bears against the step 24*c* on the punch sleeve 24, allowing only the punch pin 22 to be lowered, with the tapered portion 22*b* being driven further into the space defined by the punch member 26 to thereby spreading them radially outward to cause their machining surfaces 26*a* to contact the internal surface 8*e* of material (see FIG. 21). As the punch pin 22 is further driven downward, the punch sleeve 24 is also driven downward by the projection 22*d* on the punch pin 22, and the downward movement of the punch sleeve 24 is transmitted to the bottom 8*c* of the material 8, causing the material 8 to be gradually pressed into the tapered surface 10*c* and thence into the reduced diameter portion 10*b* of the punch die 10 (see FIG. 22). Finally, the material is completely pressed into the reduced diameter portion 10*b* (see FIG. 23). In the process of pressing the material 8 into the reduced diameter portion 10*b* of the press die 10, the material 8 is compressed radially inward, whereby the internal surface 8*e* thereof bears against the machining surfaces 26*a* of the punch members 26, which thus form axially extending blind grooves.

Figure 24:
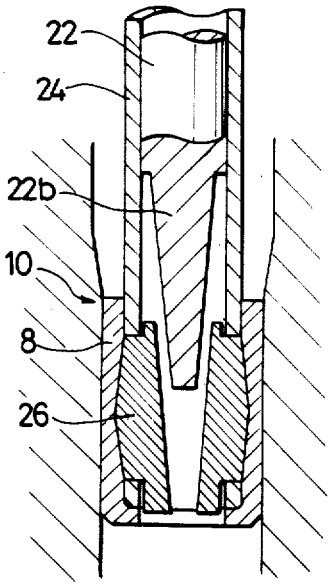
Figure 25:
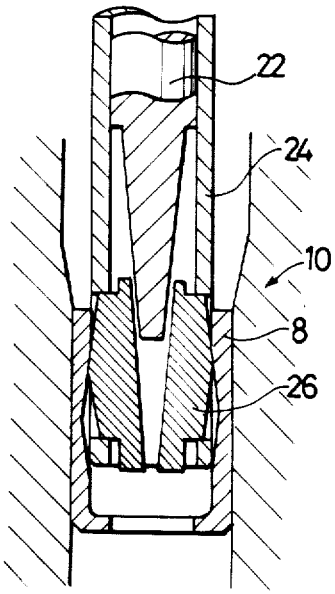

When the punch pin 22 is driven upward after the grooves have been formed in the internal surface 8*e*, only the pin 22 moves upward initially (see FIG. 24), followed by the abutment of the annular projection 22*d* on the punch pin 22 against the lower surface of the flange member 28 to cause an upward movement of the flange member 28 and its integral punch sleeve 24 and the punch members 26. Since the punch pin 22 have already been raised as indicated in FIG. 24, the punch members 26 are allowed to retract toward the axis, and thus can be easily disengaged from the blind grooves for upward movement, as indicated in FIG. 25. Thus, similar results can be achieved with this embodiment as mentioned previously.

While the invention has been illustrated and described above in connection with several embodiments thereof, it should be understood that a number of changes, modifications and substitutions will readily occur to one skilled in the art without departing from the scope and spirit of the invention as defined by the appended claims.

What is claimed is:

1. A method of manufacturing a valve sleeve having a plurality of axial grooves formed in the internal surface of a hollow cylindrical material and which are closed at their lengthwise ends utilizing a punch pin having plural longitudinally extending guide means thereon each supporting a punch member for movement along the length of said guide means relative to said punch pin and a die having means defining a bore having an inner diameter which is substantially equal to the outer diameter of a valve sleeve to be manufactured and a tapered surface which is located above the bore and having a diameter which increases toward an open end into which said punch pin and valve sleeve are to be inserted, comprising a shaping of a hollow cylindrical member having an inner and an outer diameter, both of which are greater than those of said valve sleeve to be manufactured, inserting said punch into said cylindrical material and said cylindrical material into said open end of said bore, urging said punch pin and said cylindrical material further into said open end until said cylindrical material contacts said tapered surface whereupon said punch pin and cylindrical member are moved into said bore, compressing said cylindrical material with said punch pin disposed therein from the radial outside thereof, moving said punch members radially outwardly of said punch pin and said guide means in response to an insertion of said punch pin and said cylindrical member further into said bore to cause said punch pin and said radially outwardly projecting punch members to bear against the internal surface of the cylindrical member, said punch members thereby forming a plurality of axial grooves on the inside wall surface of said cylindrical member.

2. A method of manufacturing a valve sleeve according to claim 1 in which said shaping of a hollow cylindrical member comprises disposing a round rod in a die, and applying a press operation to the rod by using a solid cylindrical punch.

3. A method of manufacturing a valve sleeve according to claim 1 in which each punch member has a machining surface of a given inclination with respect to an axis of said punch pin which does not change as said punch member moves in the radial direction of said punch pin.

4. A method of manufacturing a valve sleeve according to claim 1 in which said guide means is formed by a plurality of axially extending notches, the bottom surface of which is tapered, the individual punch members being fitted into said notches and slidable therein.

5. A method of manufacturing a valve sleeve according to claim 4 in which each notch in said punch pin has a width at its bottom surface which is greater than its width measured around the external surface thereof, said punch member having a width at its bottom surface which is greater than its width measured at the machining surface, the width at the bottom surface of said punch member being greater than the width of the notch as measured at the external surface.

6. A method of manufacturing a valve sleeve according to claim 4 in which a stop is provided which prevents an axial withdrawal of said punch member from the notch in said punch pin.

7. A method of manufacturing a valve sleeve according to claim 1 in which said punch pin comprises a punch and a punch sleeve, said punch sleeve having a plurality of axially extending openings formed therein, said punch including a tapered portion which is inserted into and spaced from the punch sleeve, and a plurality of punch members held between said punch sleeve and the tapered portion of said punch and each including a machining surface which is fitted into the respective opening, said punch member being movable in a direction radially of said punch as said punch moves relative to said punch sleeve.

8. A method of manufacturing a valve sleeve according to claim 1 in which the bottom of said cylindrical member is formed with a portion which is engaged by said punch pin as said punch pin is moved further into said bore.

* * * * *

UNITED STATES PATENT AND TRADEMARK OFFICE

CERTIFICATE OF CORRECTION

PATENT NO. : 4 706 487

DATED : November 17, 1987

INVENTOR(S) : Masaaki Bandou et al.

It is certified that error appears in the above-identified patent and that said Letters Patent is hereby corrected as shown below:

On the title page Item [73] should read

--Assignee: Jidosha Kiki Co., Ltd., Tokyo, Japan
and Gunma Seikou Co., Ltd., Gunma-Ken, Japan --.

Signed and Sealed this

Twenty-first Day of June, 1988

*Attest:*

*Attesting Officer*

DONALD J. QUIGG

*Commissioner of Patents and Trademarks*